US012116099B2

(12) United States Patent
Bentgen et al.

(10) Patent No.: US 12,116,099 B2
(45) Date of Patent: Oct. 15, 2024

(54) MARINE WAKE ADAPTED RUDDER ASSEMBLY

(71) Applicant: MICHIGAN WHEEL, Grand Rapids, MI (US)

(72) Inventors: Bernard Bentgen, Dexter, MI (US); Christopher Bigler, Grand Rapids, MI (US); Kevin Mitchell, Grand Rapids, MI (US); Bruce Dieterle, Grand Rapids, MI (US); Brant Savander, Ann Arbor, MI (US); Constance Savander, Ann Arbor, MI (US)

(73) Assignee: MICHIGAN WHEEL, Grand Rapids, MI (US)

( * ) Notice: Subject to any disclaimer, the term of this patent is extended or adjusted under 35 U.S.C. 154(b) by 0 days.

(21) Appl. No.: 17/788,218

(22) PCT Filed: Dec. 18, 2020

(86) PCT No.: PCT/US2020/065893
§ 371 (c)(1),
(2) Date: Jun. 22, 2022

(87) PCT Pub. No.: WO2021/194587
PCT Pub. Date: Sep. 30, 2021

(65) Prior Publication Data

US 2023/0027488 A1 Jan. 26, 2023

Related U.S. Application Data

(60) Provisional application No. 62/952,831, filed on Dec. 23, 2019.

(51) Int. Cl.
*B63H 25/38* (2006.01)

(52) U.S. Cl.
CPC ..... *B63H 25/38* (2013.01); *B63H 2025/388* (2013.01)

(58) Field of Classification Search
CPC ..... B63H 25/38; B63H 2025/388
See application file for complete search history.

(56) References Cited

U.S. PATENT DOCUMENTS 1,900,011 A * 3/1933 Durham ..... C23F 13/02 114/65 R
4,024,827 A * 5/1977 Becker ..... B63H 25/381 114/165

(Continued)

FOREIGN PATENT DOCUMENTS

CN 204775970 U 11/2015
DE 3441017 A1 * 5/1986

(Continued)

OTHER PUBLICATIONS

International Search Report and Written Opinion of PCT/US2020/065893, filed Dec. 18, 2020.

*Primary Examiner* — John M Zaleskas
(74) *Attorney, Agent, or Firm* — DICKINSON WRIGHT PLLC

(57) ABSTRACT

A system for designing and assembling a ships rudder that allows for the manufacture of the rudder components, namely a rudder stock and rudder blade independently, and assembling them into a completed rudder using retaining bolts and injecting an epoxy like cement or grout in order achieve the required strength characteristics.

13 Claims, 6 Drawing Sheets

(56) References Cited

U.S. PATENT DOCUMENTS

| | | | | | |
|---|---|---|---|---|---|
| 4,683,830 | A * | 8/1987 | Corlett | B63H 25/38 | 114/169 |
| 6,227,131 | B1 * | 5/2001 | Strong | B63H 25/38 | 114/162 |
| 9,463,588 | B2 | 10/2016 | Longo et al. | | |
| 2007/0000423 | A1 * | 1/2007 | Lehmann | F16C 3/02 | 114/162 |
| 2008/0134951 | A1 * | 6/2008 | Lehmann | F16C 17/14 | 114/165 |
| 2009/0056610 | A1 * | 3/2009 | Kluge | B63H 25/52 | 114/162 |
| 2009/0126614 | A1 * | 5/2009 | Kluge | B63H 25/38 | 440/51 |
| 2010/0251951 | A1 * | 10/2010 | Kuhlmann | F16C 3/026 | 29/897.2 |
| 2015/0225044 | A1 | 8/2015 | Longo et al. | | |

FOREIGN PATENT DOCUMENTS

| | | | | |
|---|---|---|---|---|
| DE | 20314325 | U1 * | 2/2005 | B63B 3/38 |
| EP | 0579533 | A1 * | 1/1994 | |
| JP | S61165299 | U * | 10/1986 | |
| JP | H07132889 | A * | 11/1993 | |
| KR | 101137816 | B1 * | 12/2011 | |
| KR | 101181799 | B1 * | 2/2012 | |
| KR | 20120129289 | A | 11/2012 | |
| KR | 20130025480 | A * | 3/2013 | |
| KR | 101291176 | B1 | 7/2013 | |
| KR | 101485255 | B1 * | 7/2013 | |
| KR | 20170016061 | A * | 8/2015 | |

* cited by examiner

MARINE WAKE ADAPTED RUDDER ASSEMBLY

CROSS-REFERENCE TO RELATED APPLICATIONS

This application is a 35 U.S.C. § 371 national phase of PCT International Application No. PCT/US2020/065893, filed Dec. 18, 2020, which claims the benefit of priority under 35 U.S.C. § 119 to U.S. Provisional Application No. 62/952,831, filed Dec. 23, 2019, the contents of which are incorporated herein by reference in their entirety.

FIELD OF THE INVENTION

The present invention is related to a component for watercraft and in particular, to a rudder assembly used for controlling the direction of movement of the watercraft.

BACKGROUND

Rudders have been used for centuries to control the direction of watercraft traveling through water while under sail, while being rowed or towed, or while under power. Conventional rudder assemblies consist of a rudder blade fixed to a shaft, normally referred to as a rudder stock, located at the aft end of a boat or ship. For self-propelled vessels, the rudder is normally located directly behind the propeller and the rudder is turned about a vertical axis for steering control, either manually or by an electric or hydraulic mechanism which is attached to a lever arm or tiller located at the upper end of the rudder stock.

Historically, on larger steel or aluminum hulled ships, rudder blades and rudder stocks have been built as welded assemblies with flat-plate rudder blades and airfoil shaped rudder blades being welded directly to the rudder stocks. Older rudder assemblies have also incorporated rudder blades that were bolted to the rudder stock through a flange, or palm piece, which is an integral part of the rudder stock.

More modern rudder assemblies incorporated in higher performance military and commercial self-propelled ships are designed with a twisted shape having surfaces which are more precisely aligned with the water flow streams exiting the propeller. This more modern rudder shape typically reduces overall appendage drag on the ship and increases overall propulsive efficiency. These rudders are typically referred to as "wake adapted" rudders.

Different methods have been used to achieve the shape of wake adapted rudders. Typically, larger rudders have been welded structures with shaped steel skins welded to an egg crate structure which is, in turn, welded directly to the rudder stock. The challenge using this approach is that the final shape and smoothness of the rudder is difficult to control and most often requires the application of fairing compound to the outside surface of the rudder to achieve the required smoothness and precise shape necessary to optimize efficiency and reduce drag. The application of this fairing compound often becomes a weak element in the design and is prone to cavitation erosion and, over time, failure of the bonding with the steel rudder surface.

The industry has also experimented with composite rudders to achieve the wake adapted shape. These rudders normally use a welded steel armature consisting of a rudder stock welded to an egg crate structure that ultimately becomes imbedded in the composite rudder blade. The composite rudder blade, often manufactured from fiberglass and/or carbon fiber, is built up over the steel armature and faired to achieve the required shape. The challenge with these composite rudders is maintaining the bond between the exterior composite blade and the internal steel armature, especially upon long-term exposure to high speed maneuvering where applied cyclic bending and torsional loads as well as severe vibration become problematic. This approach is also susceptible to failure in the case of shock (explosion) loading which is a requirement for most naval combatant craft.

A casting of bronze alloy rudder blades directly around an encapsulated rudder stock has also been attempted but with limited success. The primary advantage of this approach is that it produces a rudder blade that can be easily machined to the exact wake adapted shape after casting and results in a rudder that is inherently resistant to cavitation erosion and requires no painting or preservation. The primary problem with this direct casting approach is the unavoidable creation of copper-contamination-cracking of the rudder stock which occurs during the casting and cooling process. Experience with this approach has yielded little success in resolving this problem using normal materials and casting methods.

SUMMARY

Embodiments of the present invention improve upon the prior art by offering a design and process that allows the rudder stock and rudder blade to be manufactured separately and assembled after both parts have been cast and machined to their final dimensions and shape.

An embodiment of the invention includes a rudder stock, for example manufactured from a high strength stainless steel alloy, and a rudder blade, for example manufactured from a high strength bronze alloy. The rudder stock is manufactured with a cylindrical upper shaft portion that is mounted to the ship through rudder bearings, and a tapered and slightly twisted lower section that is inserted into the rudder blade.

At the point where the rudder stock meets the top of the rudder blade, the rudder stock can either be cylindrical or tapered to form an interference fit as described herein.

At the bottom of the tapered and twisted section of the rudder stock, the rudder stock is machined for the installation of one or more retaining bolts that are sized to withstand both the static and dynamic tensile loads of the rudder blade on the rudder stock.

The rudder blade can be made from a solid casting or it can be made as a "cored" casting with hollow voids to reduce the overall weight of the rudder.

The rudder blade is cast with a tapered and twisted cavity that matches the shape of the lower insert portion of the tapered rudder stock described above. This cavity is intentionally slightly larger than the tapered rudder stock by a nominal dimension of, for example about one-half inch, but this dimension can be revised if necessary through experimentation. This leaves an intentional gap between the rudder blade and the rudder stock along the entire length of the tapered portion of the rudder stock.

At the upper section of the rudder blade, where the rudder stock meets the rudder blade, the opening at the top of the rudder blade is cast to form a close fit with the diameter of the rudder stock, or this upper section can be machined to form a tapered mechanical or hydraulic interference fit.

At the bottom of the rudder blade, holes are either cast or machined into the blade to accommodate the installation of one or more retaining bolts or other fasteners.

Near the bottom of the rudder blade, injection holes are machined into both sides of the rudder blade from the outside of the rudder into the bottom of the rudder stock cavity. After the rudder blade and rudder stock are assembled together using the bottom retaining bolts or other fasteners, the rudder is positioned vertically, and an epoxy-like cement or grout such as Chockfast, is injected into the rudder stock cavity through the injection holes and allowed to cure.

The design of the rudder components, including the selection of materials and the selection of epoxy-like cement or grout, will be dependent upon engineering analysis of the combined structure to ensure that it complies with applicable regulations and standards.

DETAILED DESCRIPTION OF THE PREFERRED EMBODIMENTS

Figure 1:
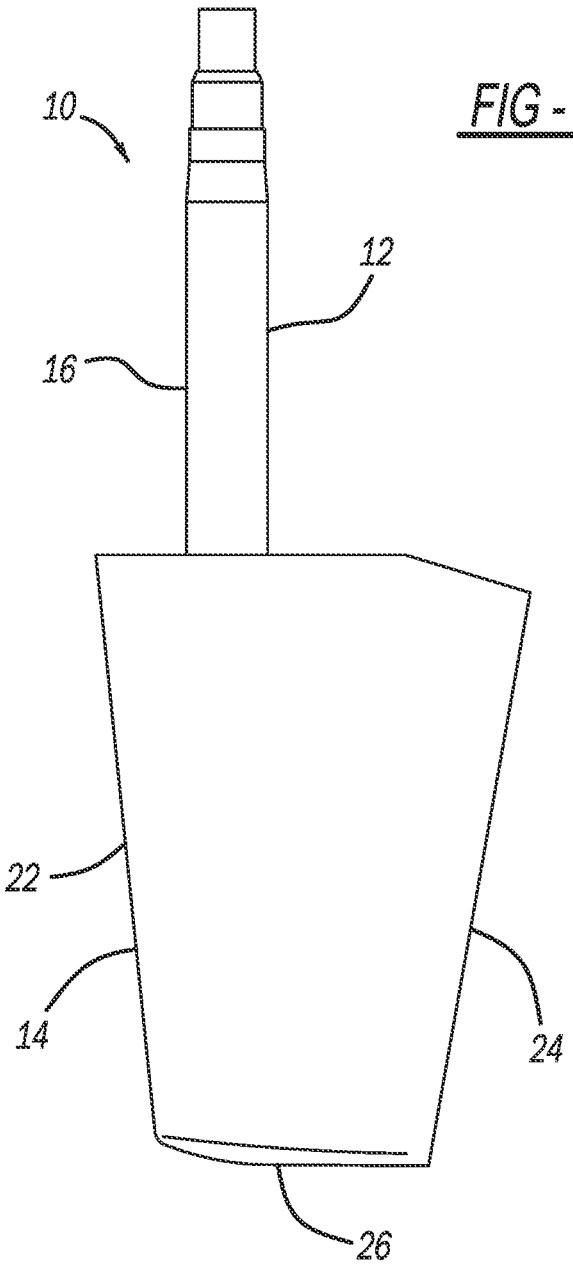
FIG. 1 is an elevational view of the rudder assembly in accordance with the present invention shown as a port side view.
Figure 2:
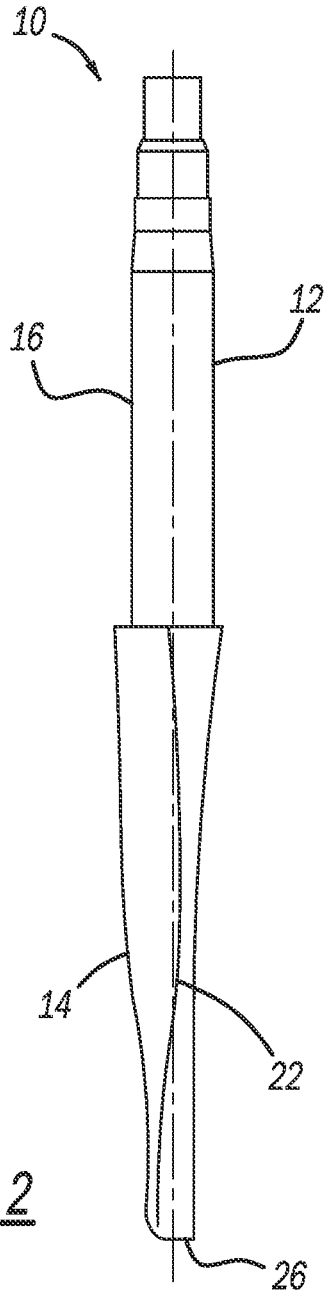
FIG. 2 is an elevational view of the assembly of FIG. 1 shown in a front view.
Figure 3:
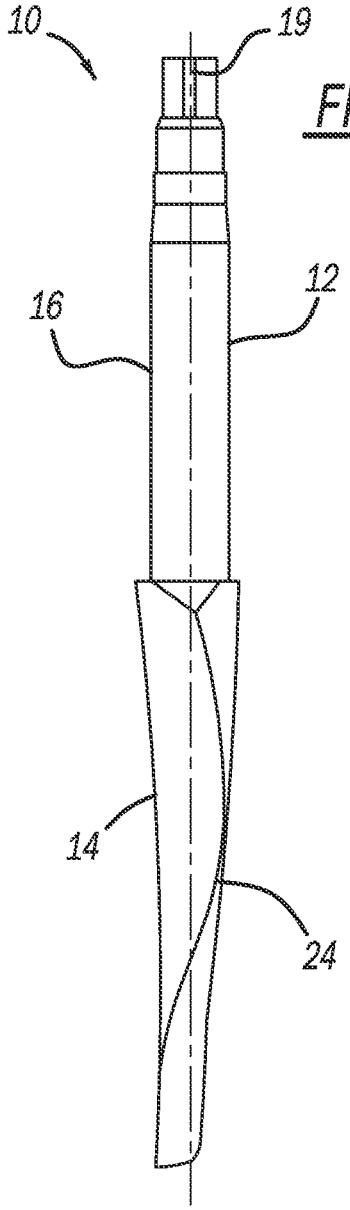
FIG. 3 is an elevational view of the assembly of FIG. 1 shown in a rear view.

With particular reference to FIGS. 1-3 rudder assembly 10 in accordance with an embodiment of the present invention is illustrated. Rudder assembly includes as principal components, rudder stock 12 and rudder blade 14.

Figure 5:
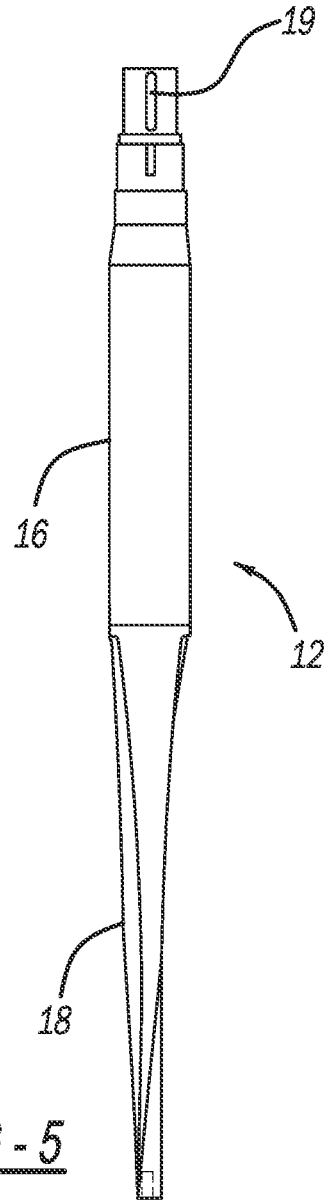
FIGS. 5 and 6 are elevational views of the rudder stock component shown respectively in rear and side views.
Figure 6:
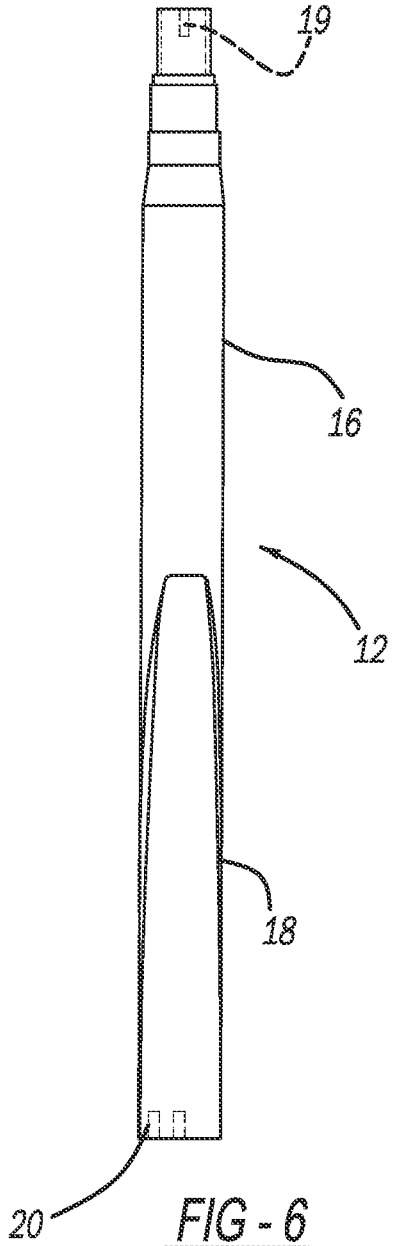

Rudder stock 12 is shown in more detail in FIGS. 5 and 6. Rudder stock 12 is in the form of an elongated element having an upper shaft portion 16 and a lower insert portion 18. Upper shaft portion 16 has a generally cylindrical outer circumference and is adapted to provide a structural connection with a ship's steering system including associated torsional couplings which can engage features 19 formed at the top end of the shaft as shown in these figures. Of course various other designs for providing a mechanical connection for high torque force coupling can be employed for rudder stock 12. Upper shaft portion 16 also provides for mounting within suitable bearing elements for steering motion and further this portion is designed to restrain against the significant bending, vibration, cyclical, and shock loads applied to the rudder assembly during use.

Lower shaft portion 18 has a twisted blade-like configuration which is adapted for closely fitting within central cavity 30 of rudder blade 14, as will be described further in detail as follows. The lower end of lower insert portion 18 features, in one exemplary embodiment, a pair of threaded bores 20 having a function which will be described in more detail later.

FIGS. 7-10 show additional features of rudder blade 14 which features leading edge 22, trailing edge 24 and bottom surface 26. Rudder blade 14 is, in the illustrated embodiment, a cast structure having internal voids for reducing weight and material requirements. As evident from the cross-sectional views of FIGS. 8-10, the upper portion of the blade features three internal cavities including leading edge cavity 28, central rudder stock cavity 30, and trailing edge cavity 32. Central cavity 30 has an open upper end 33 and a blind (enclosed) bottom end 34. As explained previously, rudder blade 14 has a twisted configuration which provides improvements in propulsion efficiency as it cooperates with the thrust vortex created by the ships propeller (not shown) positioned immediately in front of rudder assembly 10. Rudder blade 14, in addition to having a twist along its vertical axis, is also tapered such that the leading edge cavity 28 in this embodiment grows smaller and disappears at the lower end of the blade.

Figure 4:
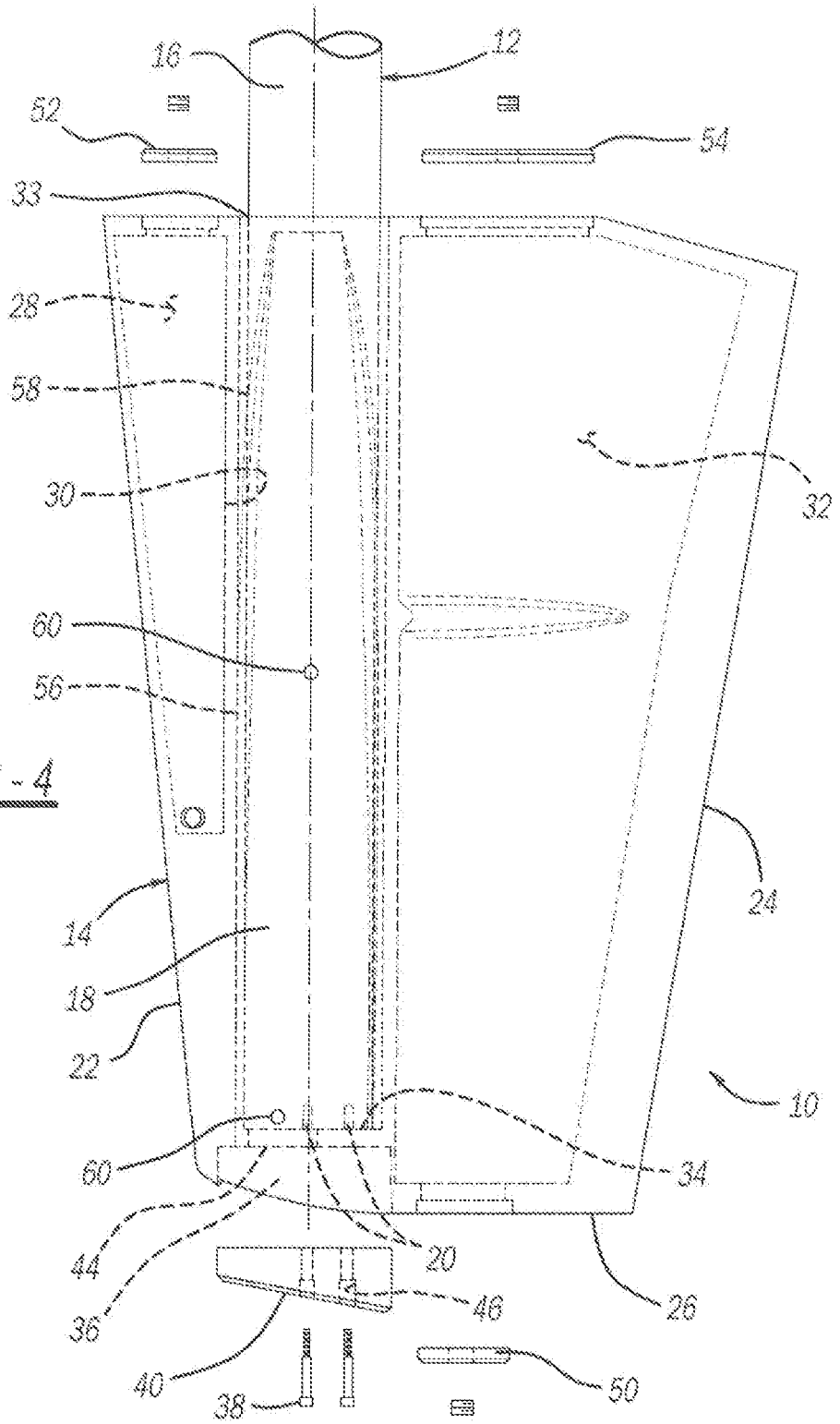
FIG. 4 is a detailed elevational view of the rudder blade showing internal features in phantom and showing certain components exploded from the assembly.
Figure 7:
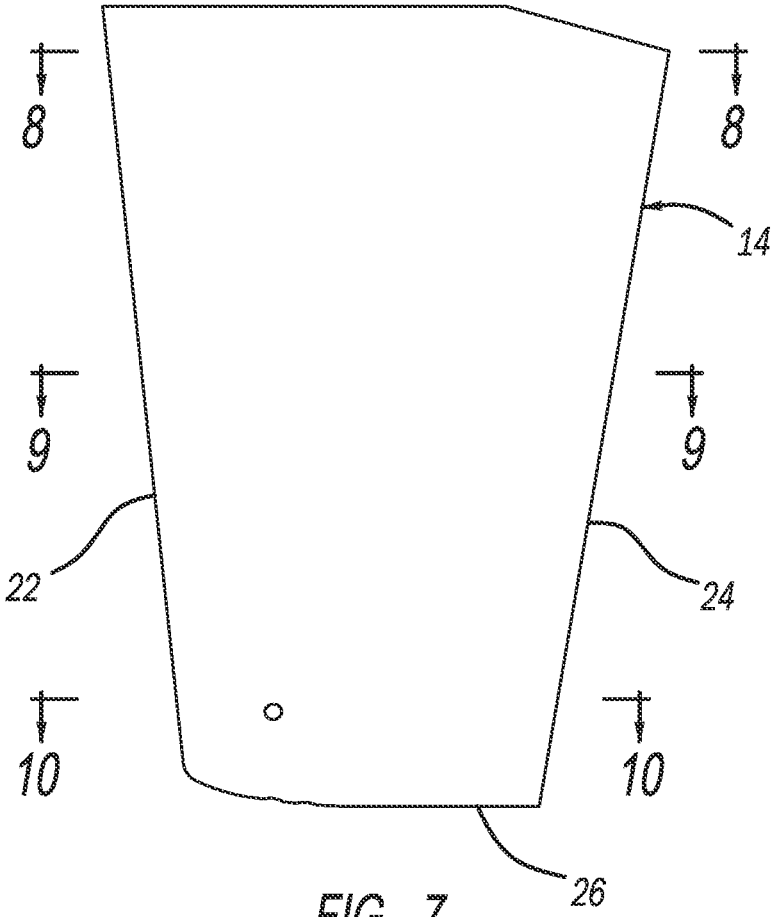
FIG. 7 is an elevational side view of the rudder blade.
Figure 8:
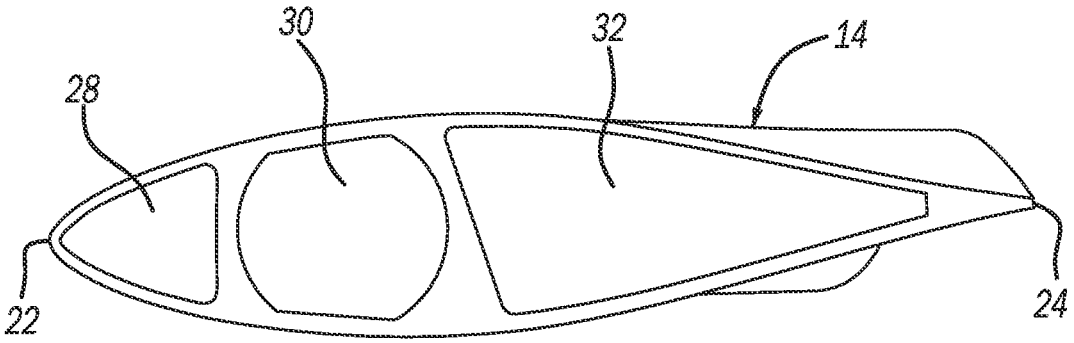
FIG. 8 is a cross-sectional view through the rudder blade of FIG. 7 taken along lines 8-8 of FIG. 7.
Figure 9:
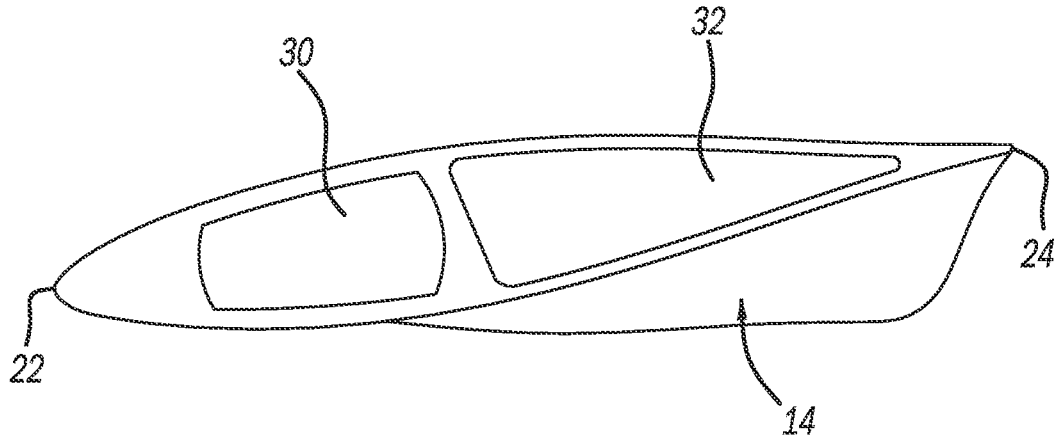
FIG. 9 is a cross-sectional view through the rudder blade of FIG. 7 taken along lines 9-9 of FIG. 7.
Figure 10:
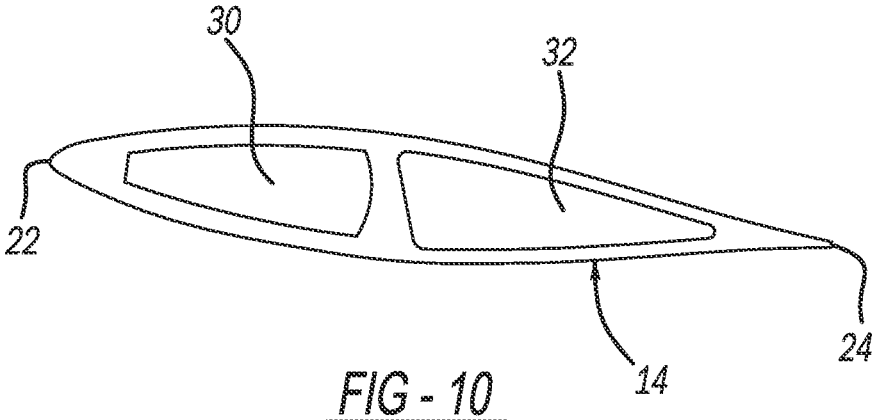
FIG. 10 is a cross-sectional view through the rudder blade of FIG. 7 taken along lines 10-10 of FIG. 7.

FIG. 4 shows rudder stock lower insert portion 18 fit within central rudder stock cavity 30 of blade 14. The twisted blade-like configuration of the lower insert portion 18 follows the twisted contours of rudder stock cavity 30. Ideally, a small radial gap 56 of uniform dimension is formed around insert portion 18 and the inside surface of rudder stock cavity 30. For example, in one embodiment, this radial gap 56 or separation distance measures approximately 0.5 inches, although the design gap would be a function of many variables. A mechanical attachment is provided at the lower end of insert portion 18 featuring bores 20 mentioned previously. A structural connection between rudder stock insert portion 18 and rudder blade 14 is provided in the form of mechanical fasteners such as screws 38. In one design, at the bottom of rudder blade 14, bores are cast or machined into the rudder blade casting. Screws 38 pass through the bores to mesh with threaded bores 20. Once screws 38 are fully torqued in position, rudder stock insert portion 18 is clamped against the bottom of the rudder blade 24. This mechanical connection is provided for structural functions and further assembles the unit as a subassembly for subsequent fabrication steps. In another variation illustrated by the Figures and particularly FIG. 4, separate insert element 40 is provided having bores 21 which fits into a mating cavity 36 at rudder blade bottom surface 26. Screws 38 pass through shouldered bores 21 in insert element 40 and engage with threaded bores 20 of rudder stock 12. Additional fasteners may be provided to connect insert element 40 to rudder blade 14. Web 44 is provided between cavity 42 and rudder stock central cavity 30.

Figure 11:
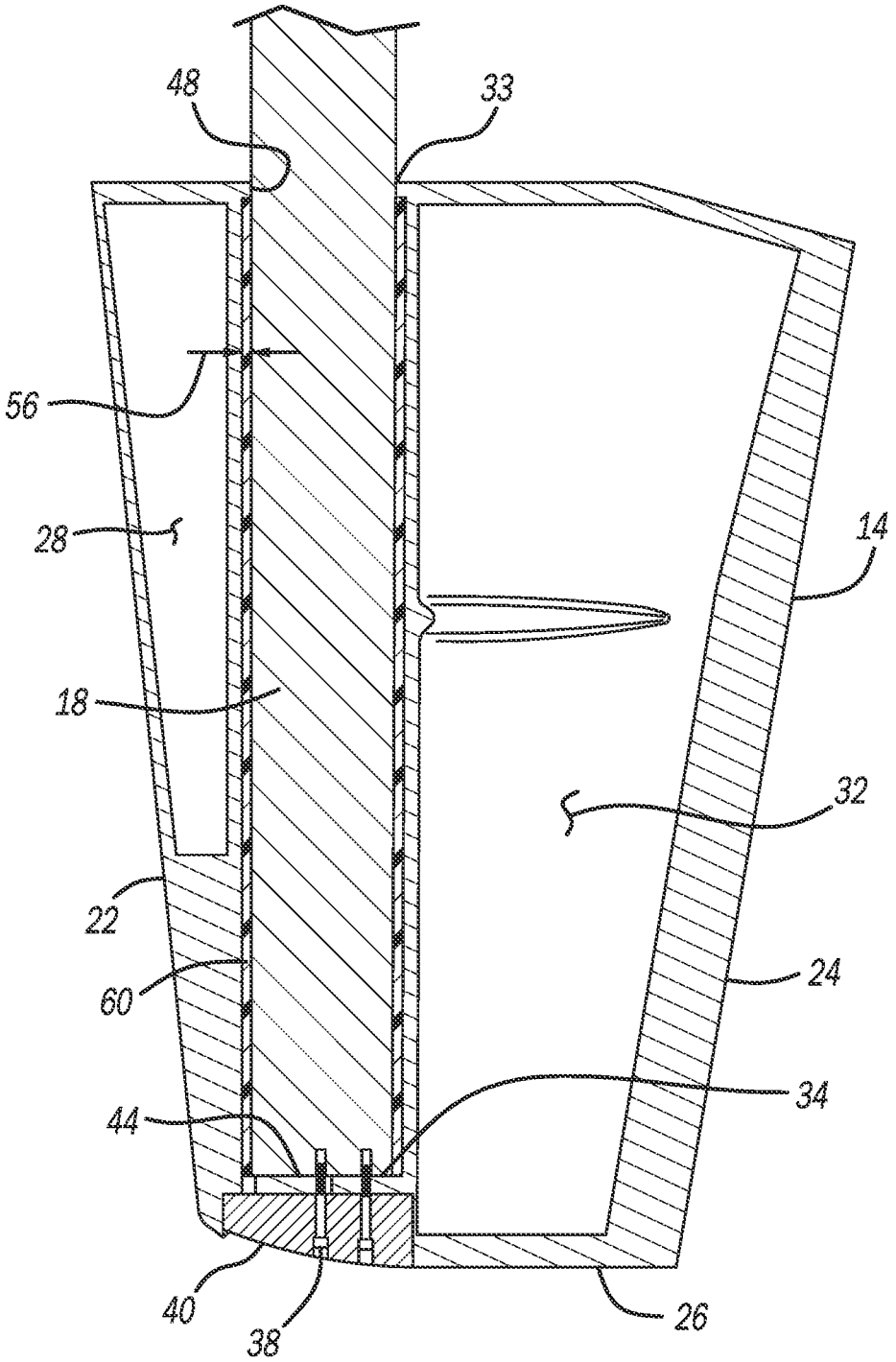
FIG. 11 is a cross-sectional view through the lower portion of the rudder assembly showing the lower portion of the shaft, the rudder blade and the chocking material.

In a preferred embodiment shown in FIG. 11, the upper portion of central rudder stock cavity 30 features shoulder 48 which closely conforms to the outer surface of rudder stock 12. Alternatively, an interference fit can be provided at shoulder 48 with rudder stock lower insert portion 18 to properly locate and secure the components of the subassembly. Moreover, this close or interference fit at shoulder 48 provides a sealed internal volume formed by gap 56. FIG. 4 shows additional closure elements 50, 52 and 54 which enclose and seal internal cavities 28 and 32 within rudder blade 14.

The mechanical fixation of rudder stock 12 within blade 14 provided by the connection at the lower end of rudder stock 12 and the interference fit at the top of the rudder stock lower insert portion 18 and establishes gap 56. This subassembly can be handled for further processing while the parts are maintained as a securely connected subassembly.

In a further manufacturing process step, the subassembly of rudder stock 12 and rudder blade 14 is placed in a fixture and an injectable material, for example an epoxy compound such as Chockfast™ is injected to fill the void between rudder stock lower insert portion 18 and the inside surface of rudder stock cavity 30, shown as element number 58. Injection can be provided through injection hole 60 shown in FIG. 4. It is preferred that the entirety of the internal volume formed by gap 56 is filled with the injectable material 58. This produces an integrated composite structure. Higher levels of torque can be transferred between rudder blade 14 and rudder stock 12 aided by the twisted configuration of the lower portion of rudder stock insert 18 and its close conformance with the inside surface of rudder stock cavity 30. One or more of the Injection holes 60 may be provided to facilitate the introduction of the injectable filler material 58.

While the above description constitutes a preferred embodiment of the present invention, it will be appreciated that the invention is susceptible to modification, variation and change without departing from the proper scope and fair meaning of the accompanying claims

The invention claimed is:

1. A marine rudder assembly comprising:

a rudder blade forming an internal central cavity elongated along a vertical axis of the rudder blade, the internal central cavity forming an inside surface along the vertical axis;

a rudder stock having an upper shaft portion and a lower insert portion, the lower insert portion forming a flattened and twisted configuration extending along the vertical axis such that the lower insert portion of the rudder stock is shaped to fit into and closely conform with a twisted contour formed in the inside surface of the internal central cavity; and an injectable filler material placed in a gap defined between the inside surface of the internal central cavity and the lower insert portion of the rudder stock.

2. The marine rudder assembly in accordance with claim 1, further comprising: the rudder blade forming a curved wake adapted outer surface forming a leading edge and a trailing edge, the trailing edge forming a curved edge shape.

3. The marine rudder assembly in accordance with claim 1, further comprising: the internal central cavity forming an open upper end and a blind bottom end formed by a web.

4. The marine rudder assembly in accordance with claim 3, further comprising: the web forming apertures receiving threaded fasteners connecting a lower end of the lower insert portion to the web.

5. The marine rudder assembly in accordance with claim 3, further comprising: the open upper end of the internal central cavity forms a shoulder providing an interference fit with the lower insert portion.

6. The marine rudder assembly in accordance with claim 1, further comprising: the rudder blade is formed of a bronze alloy.

7. The marine rudder assembly in accordance with claim 1, further comprising: the rudder stock is formed of a high strength stainless steel alloy.

8. The marine rudder assembly in accordance with claim 1, further comprising: wherein the gap creates an internal volume between the lower insert portion and the inside surface of the internal central cavity and substantially the entirety of the internal volume is filled with the injectable filler material.

9. The marine rudder assembly in accordance with claim 1, further comprising: wherein the injectable filler material is an epoxy compound.

10. A method of forming a marine rudder assembly comprising the steps of:

providing a rudder blade forming an internal central cavity elongated along a vertical axis of the rudder blade, the internal central cavity having an inside surface along the vertical axis, providing a rudder stock having an upper shaft portion and a lower insert portion, the lower insert portion forming a flattened and twisted configuration extending along the vertical axis such that the lower insert portion of the rudder stock is shaped to fit into and closely conform with a twisted contour formed in the inside surface of the internal central cavity, locating the lower insert portion of the rudder stock into the internal central cavity of the rudder blade, and injecting a filler material into a gap defined between the inside surface of the internal central cavity and the lower insert portion of the rudder stock.

11. The method of forming the marine rudder assembly according to claim 10, further comprising: following the locating step and before the injecting step, structurally fastening the rudder stock to the rudder blade.

12. The method of forming the marine rudder assembly according to claim 10, further comprising: in the injecting step, substantially fully filling the gap with the filler material.

13. The method of forming the marine rudder assembly according to claim 10, further comprising: the internal central cavity forming an upper end and a blind bottom end, and the upper end forming a shoulder providing an interference fit with the lower insert portion, and pressing the lower insert portion into the upper end until the lower insert portion contacts the blind bottom end.

* * * * *